United States Patent [19]

Wiater et al.

[11] 4,185,688

[45] Jan. 29, 1980

[54] COOLER FAN NOISE SUPPRESSOR

[75] Inventors: Alfons M. Wiater, Adams, Mass.; Nicholas L. Paternoster, Erie, Pa.; Walter J. Pasko, Lee, Mass.

[73] Assignee: General Electric Company, N.Y.

[21] Appl. No.: 863,225

[22] Filed: Dec. 22, 1977

[51] Int. Cl.[2] ..... F28F 9/24

[52] U.S. Cl. ..... 165/122; 165/135; 181/225; 415/119; 415/210

[58] Field of Search ..... 165/135, 122; 417/363; 415/119, 210, 219 R, 213 C; 181/207, 224, 225, 283; 123/41.49

[56] References Cited

U.S. PATENT DOCUMENTS

| | | | |
|---|---|---|---|
| 2,174,677 | 10/1939 | Young | 165/135 |
| 2,467,296 | 4/1949 | Doe | 415/121 G |
| 2,710,907 | 6/1955 | Westberg et al. | 165/135 |
| 2,735,611 | 2/1956 | McLean | 417/363 |
| 3,814,538 | 6/1974 | Sjoqvist | 415/210 |
| 3,840,067 | 10/1974 | Bos | 165/122 |
| 3,937,590 | 2/1976 | Mani | 415/119 |
| 3,976,393 | 8/1976 | Larson | 415/119 |

FOREIGN PATENT DOCUMENTS

| | | | |
|---|---|---|---|
| 485410 | 10/1953 | Italy | 123/41.49 |

*Primary Examiner*—Sheldon Jay Richter
*Attorney, Agent, or Firm*—Francis X. Doyle; Richard A. Menelly

[57] ABSTRACT

A noise suppressor for a heat exchanger comprises an air duct having a larger inlet than outlet encompassing the cooling fan to provide an antiresonant space to incoming air. The noise suppressor effectively reduces the noise level emanating from supplementary air-cooled transformers mounted on electric locomotive undercarriages.

5 Claims, 9 Drawing Figures

COOLER FAN NOISE SUPPRESSOR

BACKGROUND OF THE INVENTION

In compliance with the Occupational Safety and Hazards Act Requirements for reduced noise level in electric locomotives it was determined that a substantial amount of noise is generated by power transformer assemblies mounted on the locomotive undercarriage. The primary source of transformer noise is the interaction between the high velocity air stream drawn by the cooling fan and the cooling fan motor support struts. Earlier attempts to reduce the amount of transformer noise without interferring with the transformer cooling efficiency have not heretofor been successful.

The purpose of this invention is to provide an effective noise suppressor for transformer cooling fans without decreasing the transformer cooling efficiency.

SUMMARY OF THE INVENTION

A noise suppressor having the form of a truncated cone is mounted between the cooling fan blade and the motor struts to deflect the incoming high velocity air away from the strut assembly. The large diameter of the cone frustrum receives the incoming cooling air from the fan and the small diameter of the cone frustrum deflects exiting air away from the motor support struts.

BRIEF DESCRIPTION OF THE PRIOR ART

Figure 1:
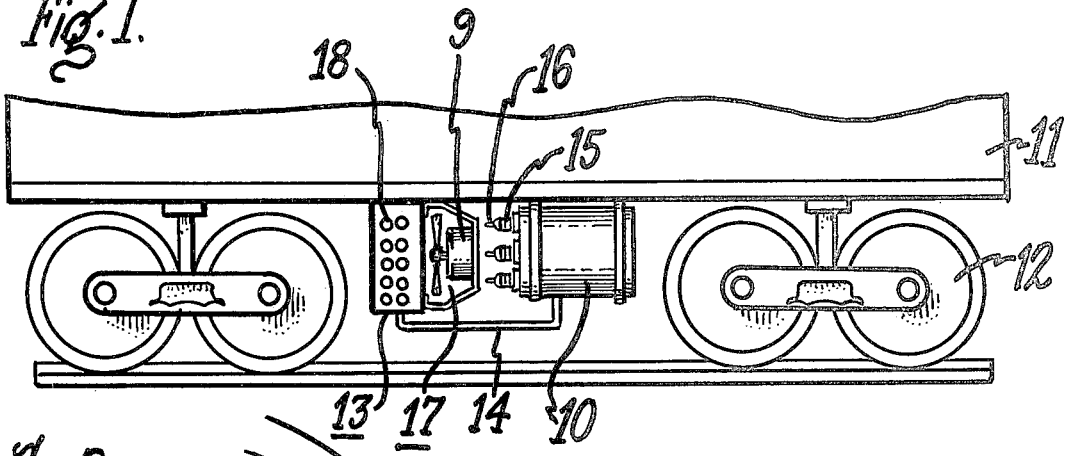
FIG. 1 is a side schematic representation of a transformer having an auxiliary cooling fan assembly and mounted on the undercarriage of an electric train.

FIG. 1 shows a prior art oil-filled transformer 10 mounted on the undercarriage of an electric train 11 supported by a plurality of metal wheels 12. The oil-filled transformer 10 is supplementary cooled by a cooling fan 17 mounted proximate a heat exchanger 13 containing a plurality of cooling tubes 18. The oil from within transformer 10 is circulated to the heat exchanger 13 by means of interconnecting pipes 14. Electrical connection is made to within transformer 10 by means of electric terminals 16 mounted on the surface of transformer 10 by means of bushings 15.

Figure 2:
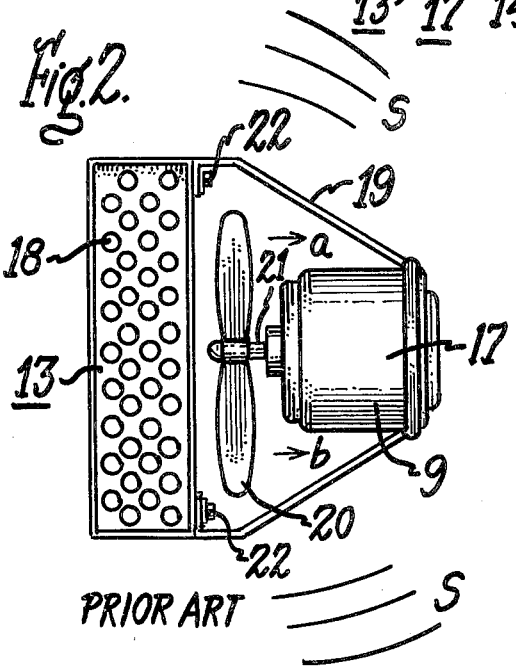
FIG. 2 is a side view in partial section of a prior art transformer cooling fan assembly.

FIG. 2 shows the mounting arrangement between the fan 17 and the heat exchanger 13. Fan 17 basically consists of a blade assembly 20 mounted to a motor 9 by means of a rotating shaft 21. The entire fan assembly 17 is connected to the heat exchanger 13 by means of a plurality of support struts 19 and bolts 22. The blades 20 are mounted in close proximity to the heat exchanger 13 in order that cooling air can be drawn in through the heat exchanger 13 at fast rate for cooling the oil-filled tubes 18. The wind direction is indicated by arrows a, b, and the generated sound is indicated by wave train S. In the process of bringing high-speed air through the heat exchanger 13, the high-wind velocity causes the struts 19 to vibrate at a rate in proportion to the wind velocity. The vibrating struts can cause the assembly 17 to vibrate at a frequency close to resonance. The mounting arrangements of the blades 20 relative to struts 19 can be seen by referring to FIG. 3. The motor 9 is fixedly attached to the struts 19 and in some instances can also be set into vibration by means of the struts 19.

Early attempts to reduce the amount of noise generated within the assembly 17 by increasing the number of struts 19 and blades 20 have not heretofor been successful. Methods for baffling the sound by interposing a physical baffling assembly around the fan 17 greatly impede the transfer of air through the heat exchanger 13.

DESCRIPTION OF THE PREFERRED EMBODIMENT

Figure 3:
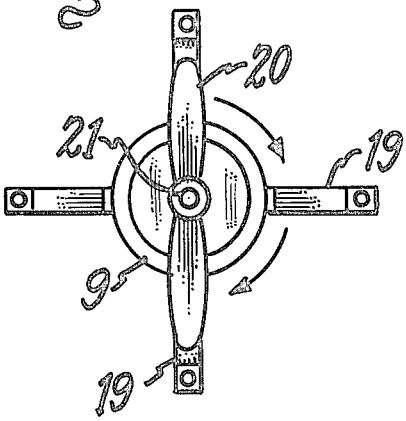
PRIOR ART Fig. 3
FIG. 3 is a front view of the fan of FIG. 2.
Figure 4:
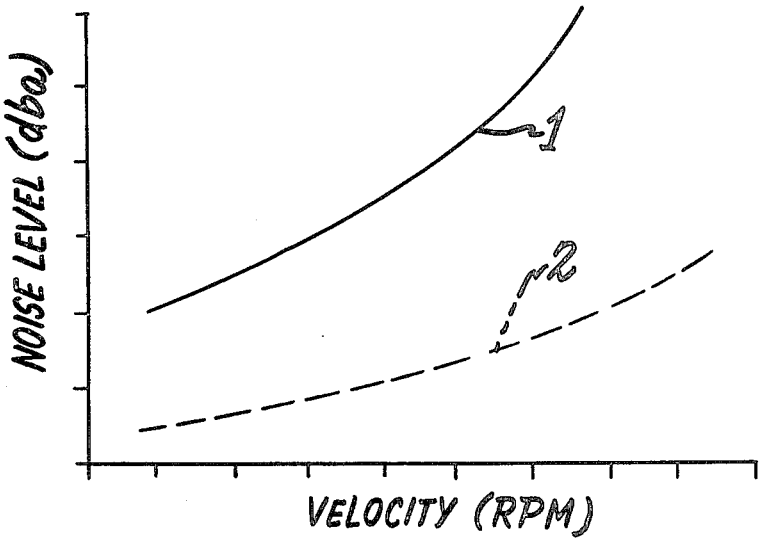
PRIOR ART Fig. 4.
FIG. 4 is a graphic representation of the noise generated by a transformer cooling fan as a function of the fan velocity.

The relationship between the nosie level 1 and velocity is shown in FIG. 4 for the prior art embodiments of FIG. 1-3.

Figure 5:
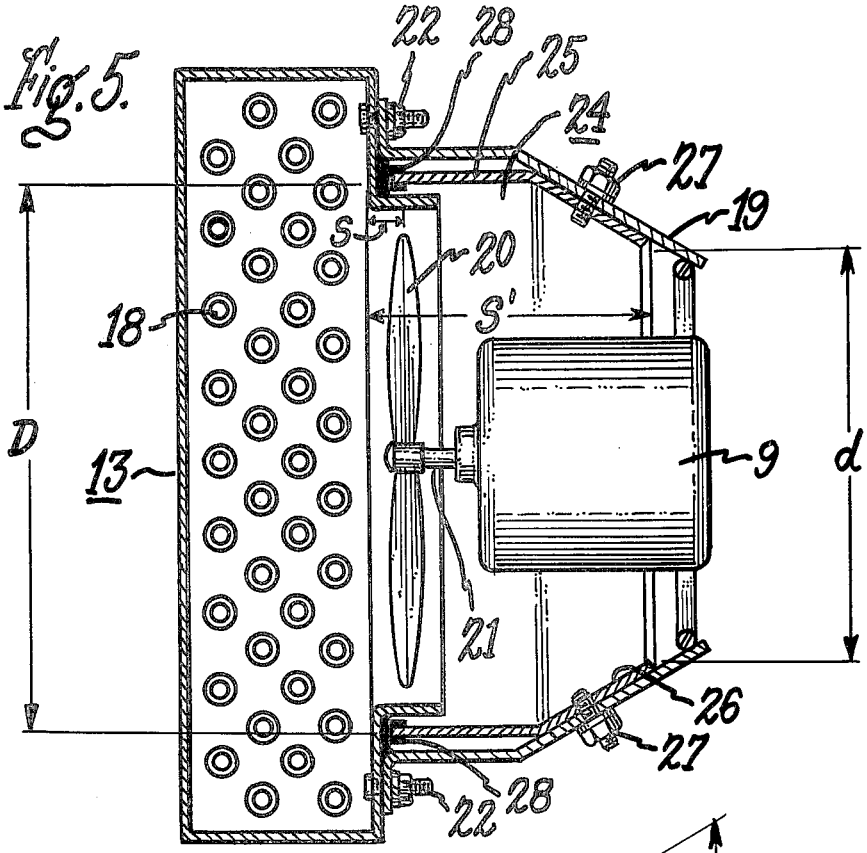
FIG. 5 is a side view in partial section of a transformer cooling fan having the noise suppressor according to the invention.

The noise suppressor 24 of this invention can be seen by referring to FIG. 5. The noise suppressor 24 has the configuration of a first cone frustrum 25 and a second cone frustrum 26 joined together in a single unitary configuration. The suppressor 24 is removably attached to the heat exchanger 13 by means of a plurality of clips 28 and is removably attached to the struts 19 by means of bolts 27. The large diameter D of the first cone frustrum 25 is located approximate the heat exchanger 13 for efficient transfer away from tubes 18. The geometry of the first cone frustrum 25 can approach that of a cylinder where the perimeter of the first frustrum 25 is essentially parallel with the struts 19. The second cone frustrum 26 substantially deviates from the plane of the first cone frustrum 25 in order to direct the incoming air out through the small diameter opening d. The purpose of the noise suppressor 24 is to prevent the incoming air from contacting the struts 19 and redirecting the air in such a manner that the struts 19 do not induce an acoustical pressure disturbance.

The beneficial effects of the noise suppressor 24 on reducing the noise level issuing from the transformer 10 of FIG. 1 can be seen in FIG. 4 where the noise level 2 for the same transformer assembly with the noise suppressor 24 attached is compared with the aforementioned noise level 1 for the transformer assembly 10 with no noise suppressor means employed.

Figure 6:
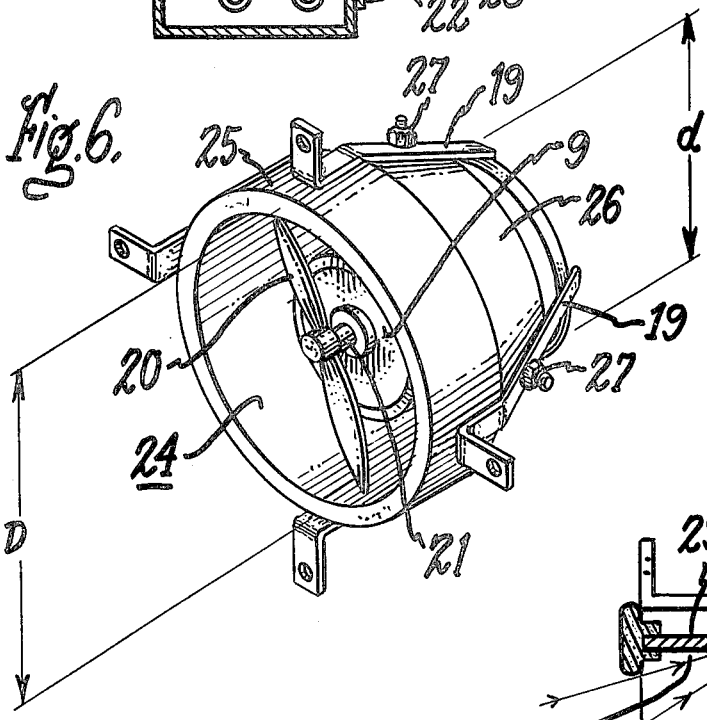
FIG. 6 is an enlarged prospective view of the noise suppressor of FIG. 5.

The configuration of noise suppressor 24 relative to struts 19 is shown in FIG. 6 with the first cone frustrum 25 having an exaggerated conical configuration and with the second cone frustrum 26 such that the diameter d of the second cone frustrum is approximately one-half that of the large diameter D of the first cone frustrum 25. The noise suppressor 24 is attached to the struts 19 by means of a corresponding plurality of bolts 27 although the noise suppressor 24 can be attached by alternative means such as for example, by welding. The noise suppressor 24 for the purpose of the embodiments of FIGS. 5 and 6 is constructed of a this sheet metal material which is readily formed into the two cone frustrum configurations employed. This is for convenience and expense only since noise suppressors can also be manufactured within the scope of th invention from a nonmetallic substance such as plastic.

Figure 7:
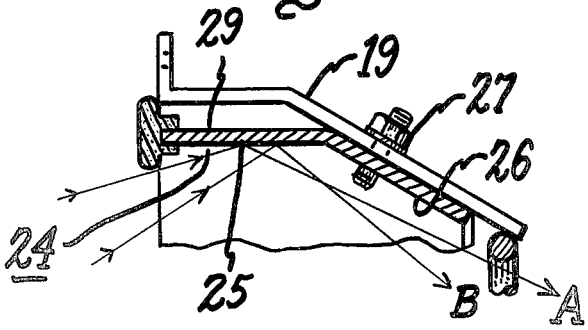
FIG. 7 is a side sectional view of a part of the noise suppressor of FIG. 6.

FIG. 7 shows how incoming arrows A & B indicating forced air flow within noise suppressor 24 are reflected upon contact with the inner walls of noise suppressor 24 and are redirected away from the vicinity of struts 19. The walls 29 of noise suppressor 24 are shown as continuous and non-perforated. For some applications, however, the walls 29 can be perforated to provide for increased air flow with only a slight effect on the overall noise reducing properties of the suppressor 24. The embodiment of FIG. 5 contains a fan assembly 17 wherein the air is drawn into the direction of the blades 20. In some instances it is desirable to cause the air flow to tranverse from the direction of blades 20 to the vicinity of tubes 18 by reversing the direction of motor 9.

Figure 8:
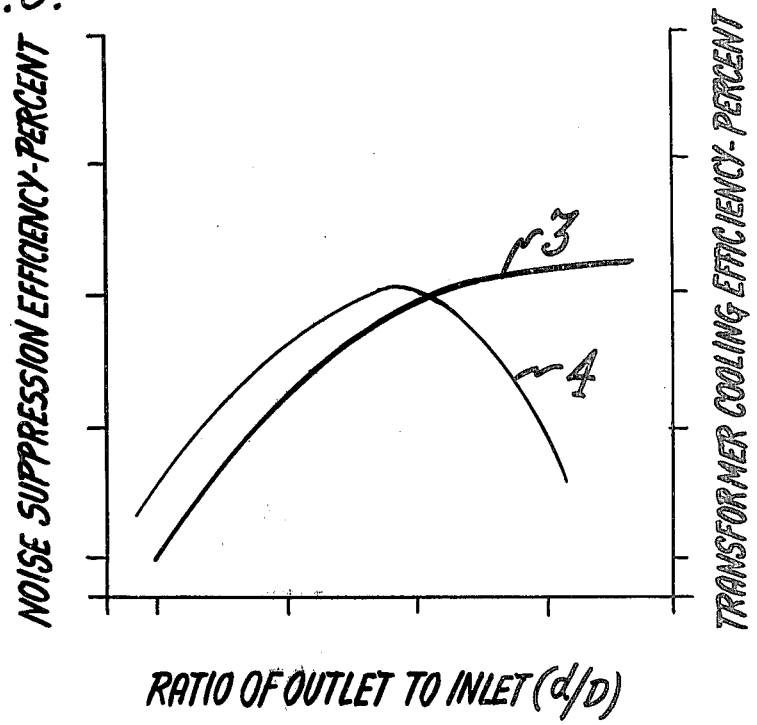
FIG. 8 is a graphic representation of the relationship between noise suppression efficiency and outlet-to-inlet ratio.

The relationship between the diameter of the noise suppressor inlet D and the diameter of the noise suppressor outlet d determines, to a large extent, the efficiency of the noise suppressor 24 for reducing sound. When the ratio of the outlet diameter to the inlet diameter (d/D) is varied and the effectiveness of noise suppressor 24 for sound reductions is determined, the ratio is found to be more effective over an intermediate range of values than at either end of the range. This is shown graphically in FIG. 8 where the noise suppression efficiency is shown as a function of the ratio of the noise suppressor outlet diameter to inlet diameter. The transformer overall cooling efficiency 3 is also shown as a function of the ratio of the noise suppressor outlet to inlet diameter. Although the noise suppression efficiency 4 goes through a defined maximum, the cooling efficiency 3 increases continuously up to a value of d/D=1 with very little improvement thereafter with increasing ratio. An efficient transformer cooling system using the noise suppressor of the invention, therefore, would have a d/D ratio of from 0.5 to 0.9 to be effective for both noise suppression efficiency and for transformer cooling efficiency.

Although the dependence of the noise suppression efficiency for the noise suppressor of the invention is not well understood, it is thought in some way to depend on the same principles that govern a Helmholtz resonator. The column of air within the area defined between the heat exchanger 13 and the fan blades 20 and designated as s provides a mass of air having a velocity determined by the spacing between tubes 18 within heat exchanger 13 and by the velocity of fan 17. This column of air presents a mass which can resonate at a frequency determined by the aforementioned dimensions when the fan velocity reaches a multiple of the resonant frequency. The interposition of the noise suppressor 24 having a well-defined resonance frequency provides an air mass defined by the area between the heat exchanger 13 and the outlet end of heat exchanger 24 designated as s'. The larger air column now provided by the dimensions of noise suppressor 24 will have a much lower resonant frequency and that defined by s. The larger air mass defined within noise suppressor 24 now has a resonance frequency too low to be excited by the volocity of fan 17. The volume of air contained within noise suppressor 24 depends upon the ratio of the noise suppressor outlet diameter d to the noise suppressor inlet diameter D. When the inlet diameter D is fixed, for example, and the outlet diameter d is caused to vary, the fundamental frequency for resonance can also vary over a wide range. In the absence of noise suppressor 24 the area defined by s would have a constant velocity of motion depending upon the spacing between cooling tubes 18 within heat exchanger 13 and the velocity of fan 17 as mentioned earlier. The interposition of struts 19 within prior art devices as shown in FIG. 2 sets up a velocity gradient in the vicinity of struts 19 caused by the wake of air existing behind struts 19. The velocity gradient caused by the distrubance of the air flow pattern by struts 19 can actually provide a beat frequency to the sound emanating from within the column of moving air. When the blade frequency equals an integral number of these "beat pulses" a pronounced increase in noise level occurs. When the system of FIG. 2 employs more than one fan 17 the increased noise output is found to vary with time. Stroboscopic measurements on the variation in blade velocity between both fans reveal that the resonant sound occurs only when their corresponding fan blades are in phase relative to a fixed strut 19.

Figure 9:
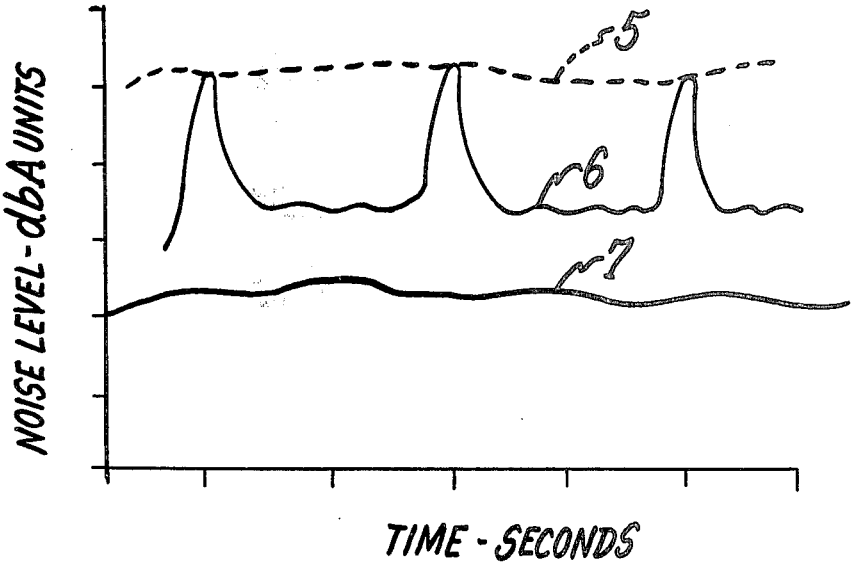
FIG. 9 is a graphic representation of the fan noise as a function of time.

The noise level for different transformer cooling systems as a function of time is shown in FIG. 9. The noise level for a single fan cooling system 5 without a noise suppressor is shown to continuously operate at a high noise level over an extended period of time. A two-fan cooling system not containing a noise suppressor is indicated at 6 where the noise level is shown to vary as a function of time. The variation in noise level intensity as a function of time is explained by the differences in fan operating velocities as described earlier for unbaffled dual fan systems. The noise level variation as a function of time for both single and double fan cooling systems containing the noise suppressor baffle of the invention is shown at 7. It can be seen that both single and double fan systems containing the inventive noise suppressor as indicated at 7 is lower than the noise level for the single-fan unbaffled cooling system 5 and the two-fan unbaffled cooling system 6.

Although the noise suppressor of this invention is described for application with auxiliary fan-cooled oil-filled transformers, this is by way of example only. The noise suppressor of the invention finds application wherever cooling fans are employed and wherever noise generated by these fans presents an ecological or occupational nuisance.

We claim:

1. A forced air-cooling system of the type consisting of a heat exchanger with a fan assembly mounted on the heat exchanger by a plurality of support struts extending between said heat exchanger and said fan assembly comprising:

a noise suppressor attached to the heat exchanger by said plurality of support struts and at least partially encompassing the fan for providing an antiresonant chamber for cooling air being drawn through the heat exchanger, said noise suppressor consisting of an air transfer duct having a circular inlet opening for receiving said cooling air and a circular outlet opening for expelling said cooling air, the ratio of the diameter of the outlet to the diameter of the inlet opening being from 0.5 to 0.9 for suppressing the fan noise without interfering with the cooling air flow.

2. The cooling system of claim 1 wherein the air duct comprises a truncated cone wherein the inlet opening is defined by one end of the cone and the outlet opening is defined by another end of the cone.

3. The cooling system of claim 1 wherein the fan assembly further includes a fan motor and wherein the noise suppressor at least partially encompasses the fan motor.

4. The cooling system of claim 1 wherein the noise suppressor is removably attached to at least one of the support struts.

5. The cooling system of claim 4 wherein the noise suppressor is removably attached to the support struts at one end and to the heat exchanger at another end.

* * * * *